United States Patent [19]

Holtz

[11] 4,125,383

[45] Nov. 14, 1978

[54] ASHLESS FUEL DETERGENT ADDITIVES

[75] Inventor: Hans D. Holtz, Bartlesville, Okla.

[73] Assignee: Phillips Petroleum Company, Bartlesville, Okla.

[21] Appl. No.: 676,257

[22] Filed: Apr. 12, 1976

[51] Int. Cl.[2] ..... C10L 1/22; C07C 102/04

[52] U.S. Cl. ..... 44/66; 44/72; 44/73; 260/553 R; 260/553 E; 260/561 R

[58] Field of Search ..... 44/66, 72, 73; 260/561 R, 553 R, 553 E

[56] References Cited

U.S. PATENT DOCUMENTS

| | | | |
|---|---|---|---|
| 2,394,307 | 2/1946 | Hentrich et al. | 260/553 R X |
| 2,622,018 | 12/1952 | White et al. | 44/66 UX |
| 2,731,383 | 1/1956 | O'Neill et al. | 260/561 R X |
| 3,298,955 | 1/1967 | Strang | 260/561 R X |
| 3,523,925 | 8/1970 | Kamal et al. | 260/561 R X |
| 3,621,040 | 11/1971 | Gagneux | 260/552 R X |
| 3,894,849 | 7/1975 | Poiss | 44/66 |
| 3,909,427 | 9/1975 | Schiff | 44/73 |
| 3,951,614 | 4/1976 | Honnen et al. | 44/72 X |

*Primary Examiner*—Allen B. Curtis

[57] ABSTRACT

A long chain monocarboxylic acid, a polyamine, and an isocyanate containing about 12 to 18 carbon atoms are reacted to provide compounds which are suitable as ashless detergent additives. Optionally, these compounds can be further reacted with hydrocarbyl sulfonic acid. The method for producing these compounds is also provided. In a preferred embodiment the ashless fuel detergent additives are combined with hydrocarbons suitable as fuel in an internal combustion engine to provide ashless fuel detergent compositions.

20 Claims, No Drawings

ASHLESS FUEL DETERGENT ADDITIVES

BACKGROUND OF THE INVENTION

This invention relates to additives for hydrocarbons suitable as fuel in an internal combustion engine. In one of its aspects this invention relates to detergent additives for hydrocarbon fuels. In another of its aspects this invention relates to ashless fuel detergent additives for use in hydrocarbon fuel in internal combustion engines. In yet another aspect of the invention it relates to compounds containing a plurality of different functional moieties combining to produce superior ashless fuel detergent qualities.

With the advent of pollution standards for automobile exhausts it has become important that fuel additives not contain metal ions which tend to poison the catalyst in automotive engine exhaust converter systems. It is well known that amide, sulfonate, and amine functional groups can provide engine protection as fuel and lubricant additives. Up until now, however, additive packages have been made up of mixtures of several different compounds such as amides formed by the reaction of dicarboxylic acid with alkylene polyamines, amine salts of sulfonic acids or reaction products of a polyamine and a petoleum sulfonic acid. In this invention multiple detergent functionalities are combined into a single molecule by combining amide, isocyanate, amine and sulfonate functionalities together with long hydrocarbon chains which enhance solubility in fuels and lubricants.

It is therefore an object of this invention to provide multiple detergent functionalities for internal combustion engine fuels in a single molecule. It is another object of this invention to provide a method for producing ashless fuel detergent additives comprising multiple functionalities in a single molecule. It is still another object of this invention to provide an ashless detergent fuel composition combining an ashless fuel detergent additive with a hydrocarbon suitable for use as fuel in an internal combustion engine.

Other aspects, objects and the various advantages of this invention will become apparent upon reading the specification and the appended claims.

STATEMENT OF THE INVENTION

A method for producing an ashless fuel detergent additive for an internal combustion engine for combining multiple detergent functionalities in a single molecule is provided by (1) reacting a long chain monocarboxylic acid, isocyanate, and polyamine to produce multi-functional molecular entity product. Although the monocarboxylic acid, isocyanate and polyamine can be reacted simultaneously, usually two of the reactants are first combined to produce a first product with the third reactant then added to produce a second product. Optionally, this product can be further treated with hydrocarbyl sulfonic acid for additional functionality.

A compound suitable as an ashless fuel detergent additive for an internal combustion engine is provided which is a compound prepared by reacting an isocyanate, a polyamine and a long chain monocarboxylic acid to obtain an amide product containing at least one equivalent of both carboxylic acid and isocyanate in each molecule of the final product. Upon reaction of this product with hydrocarbyl sulfonic acid a sulfonate moiety is added to the product molecule.

A composition suitable as an ashless, detergent fuel for internal combustion engines is also provided by combining an effective amount of the ashless fuel detergent additive compounds of this invention with a hydrocarbon or hydrocarbon mixture suitable for use as fuel in an internal combustion engine. This embodiment of the invention can also be stated as a method for reducing engine deposits in internal combustion engines by adding to a hydrocarbon fuel the compounds prepared by this invention in an amount effective as an ashless fuel detergent.

The additives of this invention can be produced by reacting sequentially a multi-amine (polyamine) with a long chain monocarboxylic acid to form an amide. This product, which need not be recovered from the reaction mixture, is then treated with an isocyanate to form a product containing urea and amide functionalities along with long hydrocarbon chains in the same molecule.

The additives of this invention can also be produced by sequentially reacting a multi-amine with an isocyanate and subsequently reacting that product with a long chain monocarboxylic acid to incorporate the desired functionalities in the same molecule.

Subsequent to the reaction of monocarboxylic acid, isocyanate and multi-amine additional reaction of the molecule produced with a sulfonic acid or mixture of sulfonic acids produces a molecule that also contains at least one sulfonate moiety.

The amine starting materials can be represented by generic formula $NH_2(CH_2CH_2NH)_xH$ where $x$ is an integer of 1–100, preferably 2–10. Typical compounds are ethylenediamine, tetraethylenepentamine, triethylenetetramine, hexaethyleneheptamine, nonaethylenedecamine, and the like.

The isocyanates have the formula R″—NCO where R″ is an aliphatic chain containing 12–18 carbon atoms, either straight chains or branched.

The monocarboxylic acids which may be used comprise a large number of acids having the general formula R′COOH in which R′ is a long chain aliphatic radical having 10–30 carbon atoms, either straight chain or branched. Mixtures of these acids commonly available from commercial sources may also be used. Representative acids are neodecanoic acid, stearic acid, oleic acid, dodecanoic acid, isostearic acid (a mixture of branched acids having 16–18 carbon atoms), eicosic acid, and the like.

The sulfonic acids useful for this invention are broadly represented by the generic formula $R''SO_3H$ where R″ is alkyl having 12–20 carbon atoms or aralkyl having 10–30 carbon atoms in the molecule with the sulfonic acid group generally attached to the aromatic nucleus. Mixtures of sulfonic acids as produced by the sulfonation of white oils and other petroleum fractions commonly known as petroleum sulfonic acids or "mahogany" acid can be used. The preferred average molecular weight range of these acid mixtures is between 150–1000. Representative acids are dodecylbenzene sulfonic acid, octadecylsulfonic acid, eicosylsulfonic acid, octadecyltoluene sulfonic acid, oleyl sulfonic acid, heptadecylbenzene sulfonic acid, etc.

At least one equivalent of each functional group is incorporated into the polyamine molecule. The positions of the various substituents will vary since all structural isomers can be formed in the reaction. There can also be a difference in the attachment of the groups depending on whether the organic acid or isocyanate was reacted first with the polyamine. In the subsequent formation of the sulfonate, the remaining primary or secondary amine functionality is involved.

The initial reaction of the amine and monobasic acid or isocyanate is carried out using a conventional stirred apparatus with a solvent selected from xylenes or petroleum naphtha with reactant added to maintain temperature in the range of about −10° C. to about 250° C., preferably about 20° C. to about 100° C. for a period of 6–8 hours. At least one equivalent of the monobasic acid or isocyanate is used. Preferably two or more of the primary or secondary amine groups present in the molecule are reacted initially. To this reaction product at least one equivalent of an isocyanate or monobasic acid is added to produce a reaction product containing at least one equivalent of monobasic acid, isocyanate, and amide per molecule.

The product of this reaction can then be reacted with the sulfonic acid to form a sulfonate. Since this is the reaction of a strong acid with a strong base, contact of the reactants results in reaction. At least one residual amine group is treated to incorporate at least one equivalent of the sulfonic acid in the molecule.

The final product is a detergent fuel additive which is used at about 1–100 lb./1000 barrels of fuel to prevent harmful carburetor and intake system deposits. The fuel can be any hydrocarbon useful as an internal combustion engine fuel, preferably hydrocarbon mixtures used in commercial fuel blends.

PREPARATION OF THE ADDITIVES

EXAMPLE I 87 g (0.295 mole) octadecylisocyanate was added to 45 g (0.308 mole) triethylenetetramine in 150 ml. xylene under nitrogen with stirring in a 2-neck flask fitted with a reflux condenser and thermometer well. The rate of addition was such as to maintain the temperature not to exceed 40° C. After removal of the solvent under vacuum, a white solid remained. This solid was an adduct of urea.

56 g of this adduct (0.127 mole) and 72 g (0.254 mole) isostearic acid were refluxed in 400 ml. xylene in a flask fitted with a magnetic stirrer, water separator and reflux condenser. About 5 ml. $H_2O$ was removed in 3 hours. The xylene was removed by distillation and the hazy product dissolved in toluene to remove gels. The product had a nitrogen content of 6.02 weight percent.

EXAMPLE II 48 g (0.11 mole) of the product of the amine and isocyanate reaction of Example I, 85 g (0.3 mole) isostearic acid and 200 ml. xylene were refluxed for 6 hours. A precipitate formed which was separated by filtration after some solvent had been removed using a "Rotavapor". The filtrate was washed first with toluene then with cyclohexane and dried. The white solid had a nitrogen content of 5.11 wt. %.

EXAMPLE III

In a 1 liter 3-neck flask equipped with reflux condenser, water separator and heating mantle were combined 96 g (0.339 mole) isostearic acid
49 g (0.339 mole) triethylenetetramine and
300 ml. xylene.

The mixture was refluxed until water evolution ceased, about 12 hours.

Then 200 ml. xylene was added and 100 g n-$C_{18}$-isocyanate (0.339 mole) was dispersed in the mixture with stirring. The temperature was about 45° C. and the mixture was allowed to cool to about 28° C. The mixture containing a little floc was filtered and solvent removed by "Rotavapor". The solid was dissolved in cyclohexane, filtered and again recovered by solvent evaporation. It was again washed with cyclohexane to give a white, waxy solid. Nitrogen content was 8.6 wt. %.

EXAMPLE IV

The procedure of Example III was repeated using the following ingredients:

56.8 g (0.2 mole) isostearic acid
18.9 ml. (0.1 mole) tetraethylenepentamine
300 ml. xylene
22.0 g (0.074 mole) octadecylisocyanate.

The purified product contained nitrogen at 6.6 weight percent.

EXAMPLE V 36.2 g (0.05 mole) of the product of Example III was reacted with 16.4 g (0.05 mole) dodecylbenzene sulfonic acid in 200 ml. toluene at room temperature. The solvent was evaporated to recover the product, a sulfonate of the amide urea prepared in Example III. Analysis of the product showed 6.2 wt. % $N_2$; 3.3 wt. % S.

EXAMPLE VI

A run similar to Example V was made using 35 g of the amide-urea of Example III (0.05 mole) and 30 g dodecylbenzene sulfonic acid (0.09 mole).

EXAMPLE VII

A run similar to Example V was made using 40 g (~0.04 mole) of the amide urea of Example V and 13 g (0.04 mole) dodecylbenzene sulfonic acid.

EXAMPLE VIII

Samples of the amide ureas and sulfonates derived from these (Examples I–VII) were tested for detergency in a Falcon engine carburetor test at the 10 lbs./1000 barrel fuel level. The results are tabulated below.

TABLE I

| Run No. | Additive Indentification | ng deposit unwashed | mg deposit n-heptane washed | unwashed % improvement |
|---|---|---|---|---|
| 1 (control) | no additive | 20.8 | 19.2 | 0 |
| 2 | Example I | 7.2 | 5.0 | 70 |
| 3 | Example II | 6.0 | 4.0 | 74 |
| 4 | Example III | 4.6 | 3.2 | 80 |
| 5 | Example IV | 6.0 | 4.0 | 74 |
| 6 | Example V | 5.9 | 4.2 | 75 |
| 7 | Example VI | 3.5 | 2.3 | 82 |
| 8 | Example VII | 3.2 | 1.8 | 83 |

The test results demonstrate that the amide-urea products decrease carburetor deposits by 70–80%. The sulfonate derivatives are slightly superior, rating consistently over 80% decrease. All of the additives are good ashless detergency additives.

I claim:

1. A method for producing an ashless fuel detergent additive comprising reacting a long chain monocarboxylic acid, an isocyanate having the formula R"NCO where R" contains 12 to 18 carbon atoms in a straight or branched chain, and a polyamine to produce molecular entities comprising functionalities of urea, amide, and long hydrocarbon chains.

2. A method of claim 1 wherein said monocarboxylic acid is reacted with a polyamine and the product of this reaction is further reacted with isocyanate.

3. A method of claim 1 wherein isocyanate is reacted with a polyamine and the product of this reaction is further reacted with a long chain monocarboxylic acid.

4. A method of claim 1 wherein said product comprising functionalities of urea, amide and long hydrocarbon chains is further reacted with sulfonic acid to produce a sulfonated product.

5. A method of claim 2 wherein said product comprising functionalities of urea, amide and long hydrocarbon chains is further reacted with sulfonic acid to produce a sulfonated product.

6. A method of claim 3 wherein said product comprising functionalities of urea, amide, and long hydrocarbon chains is further reacted with sulfonic acid to produce a sulfonated product.

7. An ashless fuel detergent additive produced by the method of claim 1.

8. An ashless fuel detergent additive produced by the method of claim 4.

9. A compound useful as an ashless fuel detergent additive prepared by reacting with a monocarboxylic acid the product of the reaction of a polyamine and an isocyanate having the formula R″NCO where R″ contains 12 to 18 carbon atoms in a straight or branched chain.

10. A compound useful as an ashless fuel detergent additive prepared by reacting the product of the reaction of a polyamine and a long chain monocarboxylic acid with an isocyanate having the formula R″NCO where R″ contains 12 to 18 carbon atoms in a straight or branched chain.

11. A compound useful as an ashless fuel detergent additive prepared by reacting a compound of claim 9 with a sulfonic acid.

12. A compound useful as an ashless fuel detergent additive prepared by reacting a compound of claim 10 with a sulfonic acid.

13. A composition comprising a hydrocarbon suitable as a fuel in an internal combustion engine and a compound of claim 9, said compound of claim 9 present in an amount effective as an ashless fuel detergent additive.

14. A composition comprising a hydrocarbon suitable as a fuel in an internal combustion engine and a compound of claim 10, said compound of claim 10 present in an amount effective as an ashless fuel detergent additive.

15. A composition comprising hydrocarbon suitable as a fuel in an internal combustion engine and a compound of claim 11, said compound of claim 11 present in an amount effective as an ashless fuel detergent additive.

16. A composition comprising a hydrocarbon suitable as a fuel in an internal combustion engine and a compound of claim 12, said compound of claim 12 present in an amount effective as an ashless fuel detergent additive.

17. A method for reducing engine deposits in an internal combustion engine comprising the addition of a detergent fuel additive of claim 9 to hydrocarbon fuel for the engine, said ashless fuel detergent being added in an amount effective to reduce engine deposits and using said hydrocarbon fuel with ashless fuel detergent additive as fuel in an internal combustion engine.

18. A method for reducing engine deposits in an internal combustion engine comprising the addition of a detergent fuel additive of claim 10 to hydrocarbon fuel for the engine, said ashless fuel detergent being added in an amount effective to reduce engine deposits and using said hydrocarbon fuel with ashless fuel detergent additive as fuel in an internal combustion engine.

19. A method for reducing engine deposits in an internal combustion engine comprising the addition of a detergent fuel additive of claim 11 to hydrocarbon fuel for the engine, said ashless fuel detergent being added in an amount effective to reduce engine deposits and using said hydrocarbon fuel with ashless fuel detergent additive as fuel in an internal combustion engine.

20. A method for reducing engine deposits in an internal combustion engine comprising the addition of a detergent fuel additive of claim 12 to hydrocarbon fuel for the engine, said ashless fuel detergent being added in an amount effective to reduce engine deposits and using said hydrocarbon fuel with ashless fuel detergent additive as fuel in an internal combustion engine.

* * * * *